United States Patent [19]

Chang et al.

[11] Patent Number: 4,986,616

[45] Date of Patent: Jan. 22, 1991

[54] WIRE DROP KEYBOARD DRAWER

[75] Inventors: Robert H. Chang, Des Plaines; Peter A. Hayman, Bensenville, both of Ill.

[73] Assignee: RC International, Inc., Elk Grove Village, Ill.

[21] Appl. No.: 458,512

[22] Filed: Dec. 28, 1989

[51] Int. Cl.[5] ..... A49B 21/00

[52] U.S. Cl. ..... 312/208; 312/323; 108/138

[58] Field of Search ..... 312/208, 323, 348, 265.1; 108/138, 143; 211/181; 220/19

[56] References Cited

U.S. PATENT DOCUMENTS

| | | | |
|---|---|---|---|
| 1,973,416 | 9/1934 | Otte | 108/143 |
| 2,994,439 | 8/1961 | Kolkey | 108/143 |
| 3,019,071 | 1/1962 | Davis | 312/348 X |
| 4,483,572 | 11/1984 | Story | 312/323 X |

*Primary Examiner*—Joseph Falk

*Attorney, Agent, or Firm*—Hill, Van Santen, Steadman & Simpson

[57] ABSTRACT

A wire form computer stand with a drop-style keyboard retaining tray is disclosed. The system includes a track system pivotally mounted to the stand's enclosure and a tray is slidably mounted within the track for storage within the stand or positioning externally of the stand in a lowered position. This system permits use of a limited surface area, permits the mounting of a monitor at a convenient height, as well as the positioning of the keyboard at a lower more comfortable height. The system is fabricated from rod or wire bent to shape which is coated with a protective coating that also reduces friction at sliding surfaces. This method of fabrication is less expensive to manufacture and sale of the system.

8 Claims, 3 Drawing Sheets

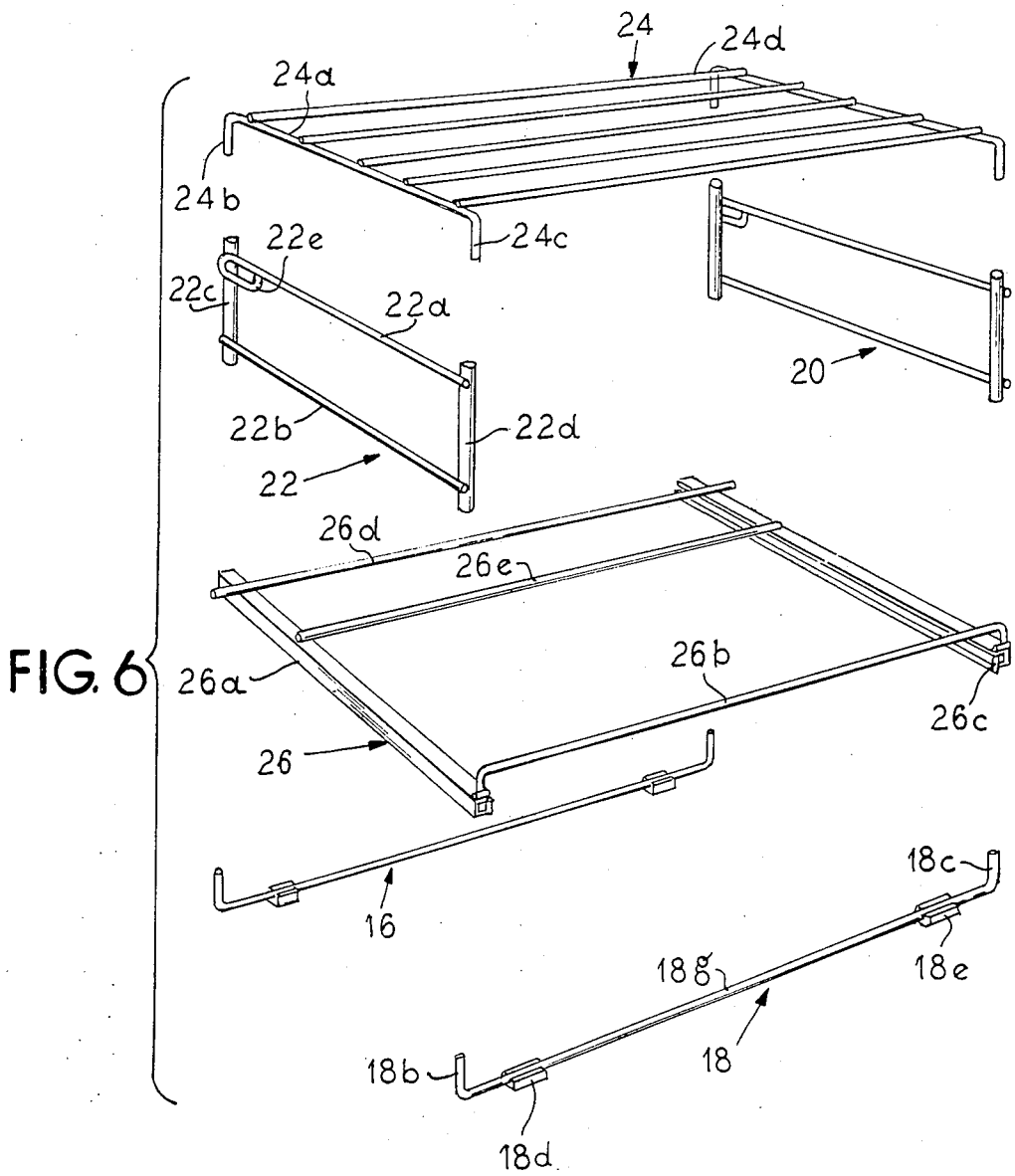
FIG. 6
FIG. 10
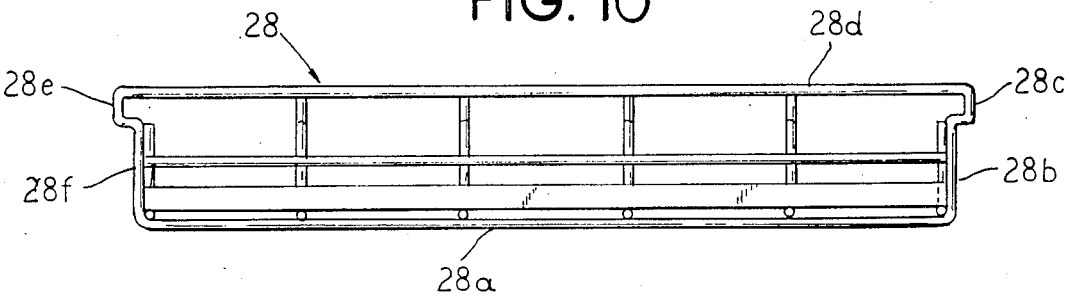

WIRE DROP KEYBOARD DRAWER

BACKGROUND OF THE INVENTION

This invention relates to a combined stand, enclosure and keyboard drawer structure of the type used to support and store a computer and movable keyboard, and more particularly, to a wire-formed stan and drop-style keyboard drawer.

Currently, a personal computer system can include physically separate but electrically connected central processing unit (CPU), monitor, and keyboard. A printer may also be part of the system. Usually, it is desirable to have the monitor, CPU and keyboard situated close together for use. Such units may be installed at a workstation with new furniture specifically for that purpose. However, at other times it is desirable to move the monitor, CPU and keyboard to various temporary locations where the system may be used on a small surface such as on a file cabinet. In such a situation the CPU rests on the surface and the monitor rests on the CPU. There, the monitor may be below eye level. Moreover, the keyboard may be used on the user's lap, may be on a surface above a comfortable height and/or may be difficult to store on the available surface.

In an effort to respond to the foregoing and other needs, the art has developed wooden or metal drawer systems. These systems include an enclosure or stand which can rest on a surface, the CPU rests on the top of the enclosure, and a drawer for the keyboard is slidably mounted within the enclosure. The monitor may be at eye level and resting on the CPU. Commonly the keyboard is stored and used at about the same height as the surface on which the enclosure is placed. In this position the keyboard may be above the optimum height for use.

It is therefore an object of this invention to provide a stand and keyboard drawer which can be used on various work surfaces, can position a monitor thereon at an eye level position, and the keyboard retaining drawer at a lower and comfortable use position, while permitting keyboard storage within the stand.

In some situations the keyboard drawer may be used in a lowered position by use of a complicated arm and lever mechanism.

It is therefore an object of this invention to provide a simple drawer lowering and support mechanism.

It has also been determined that current stands and keyboard drawers can be complex and/or expensive to manufacture.

It is another object of this invention to provide a stand and keyboard drawer system that meets the foregoing objects, is less complex to manufacture, and is less expensive to manufacture.

These and other objects of this invention will become apparent from the following disclosure and appended claims.

SUMMARY OF THE INVENTION

This invention provides a wire form stand or enclosure and drop-style keyboard drawer tray that permits use of limited surface areas in placing a computer system, to position a monitor at a convenient viewing height, as well as positioning the keyboard at a height lower than the supporting surface for comfortable use. The system includes a storage system that permits the keyboard and drawer to be stored within the stand.

Moreover, the system can be fabricated from rod or wire bent to shape and coated to provide protection and reduce friction. The stand and drawer are formed of wire rod in simple configurations. By this design and related method of fabrication, the stand is less expensive to manufacture than prior wood systems. This unique system also converts existing furniture into a personal computer (PC) workstation so as to save money and space. Moreover, this wire form design lends itself to knock-down or kit construction techniques which can reduce prepurchase assembly.

In use the drawer drops approximately three inches below the support surface for comfortable keying.

A baked epoxy surface coating provides strength and durability for long-lasting use and is beige in color to blend in with the decor. Rubber feet support the unit protect the surface on which the system is resting from damage and eliminates movement from vibrations. Assembly of this system is easy as only a limited number of parts are needed for assembly and no assembly tool is needed. Finally by being wire form, the system is lightweight and easily transported.

BRIEF DESCRIPTION OF THE DRAWINGS

FIG. 6 shows an exploded view of the stand;

FIG. 10 is a front view of the drawer.

DESCRIPTION OF THE PREFERRED EMBODIMENT

The Structure

Figure 1:
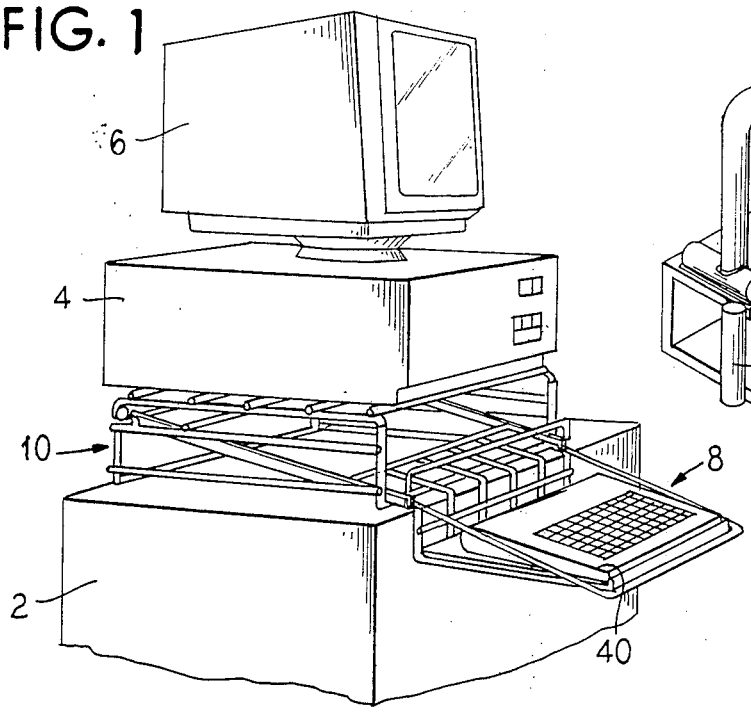
FIG. 1 is a perspective view of a complete system in operating position.
Figure 2:
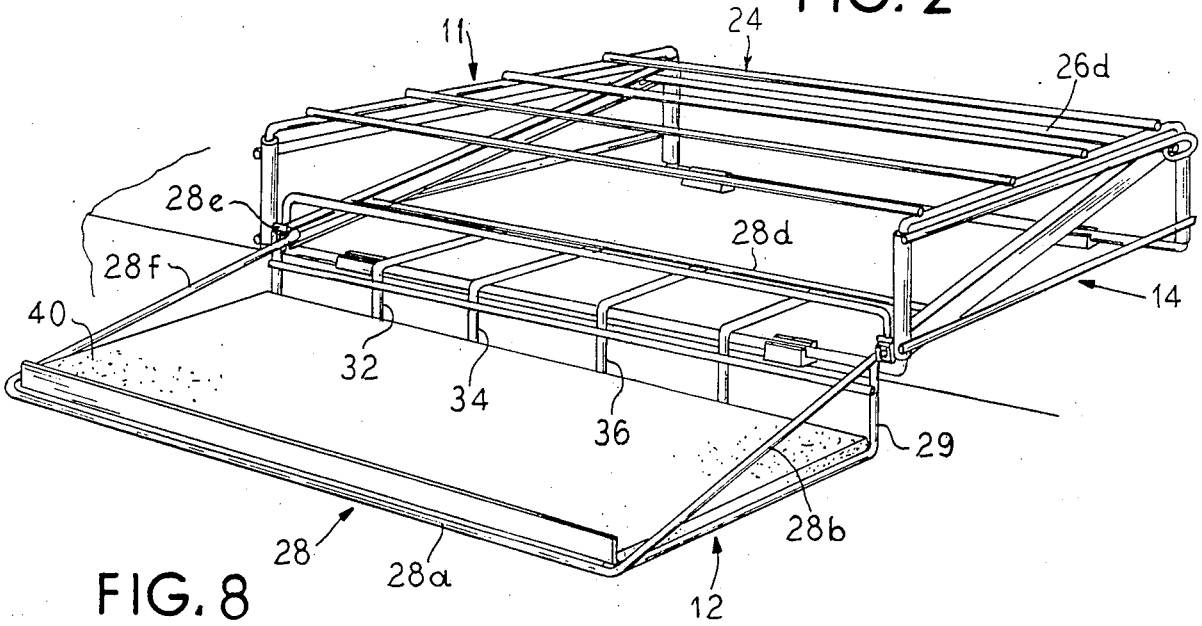
FIG. 2 is a perspective view of a stand.

Referring now to the drawings, the system is seen in FIG. 1, which shows the stand 10 resting on a cabinet 2, a CPU 4 on the stand, a monitor 6 on the CPU, and a keyboard 8 ready for use. With reference to FIG. 2, the stand 10 includes three main components, namely the enclosure 11, the keyboard retaining tray or drawer 12, and the track system 14.

The enclosure 11 is seen in FIG. 6 and is a knock-down member with the components packaged for assembly. In FIG. 6 the enclosure is shown in an exploded view. The enclosure includes front and rear wire-form supports or legs 16 and 18 which extend across the front and rear of the stand. Each leg, such as front leg 18, includes a transverse run or section such as **18*a* and a pair of upstanding ends such as 18*b* and 18*c*. A pair of rubber feet 18*d* and 18e** are mounted on the transverse section for resting on the support surface.

The enclosure also includes a pair of side frames 20 and 22. Each side frame includes a top and bottom wire member, such as **22*a* and 22*b*, and front and rear tube-like support members, such as 22*c* and 22*d*. The support members 22*c* and 22*d* are welded to the top and bottom members 22a and 22b and are spaced to interfit with the upstanding leg portions of the front and rear supports 16 and 18**, as shown.

The top wire member, such as 22a, includes a pivot-forming and retaining loop 22e formed at one end of the wire run 22a and positioned at the upper rearward corner of the side frame 22.

Figure 7:
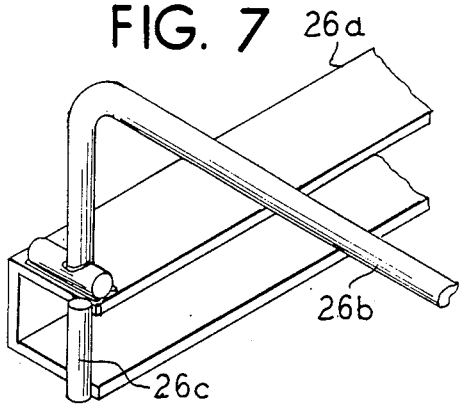
FIG. 7 is an enlarged perspective view of the front end of the drawer track showing a drawer retaining structure.

The top or shelf 24 includes a pair of front-to-rear extending side members, such as 24a, which have downwardly extending leg portions, such as 24b and 24c, for interfitting with the support members such as 22c and 22d. A plurality, in this case four, of transversely extending wire supports, such as 24d, extend between the side supports, such as 24a, and are welded to the side supports A pivotable track assembly 26 is positioned to be mounted to the sides 20 and 22 and includes a pair of C-shaped side channels 26a to which a front transverse section or handle 26b is secured. Each channel is closed by a short vertical rod, such as 26c, that acts as a stopper. The stopper function is best seen in FIG. 7. It is seen that the ends of the front handle 26b are secured to the channel 26a and extend downwardly at the front end of the channel 26a. The channels, such as 26a, are also interconnected by the transverse back pivot rod 26d that connects the side channels and extends outwardly beyond the sides thereof. An intermediate transverse support rod 26e is also provided.

The enclosure is assembled by positioning the track assembly between the side members 20 and 22 and positioning the ends of the back pivot rod 26d in the top loops, such as 22e, on each side so as to permit and define a pivotable system. The top, such as 24, can then be fitted into the sides and the supports 16 and 18 are then positioned and fitted into the sides 20 and 22. This defines the enclosure 11. It is seen, as in FIGS. 3, 4, 5 and 8, that the track system is positioned within the stand on a diagonal and can rest against the front support 18.

The drawer is also a wire formed member, which is shown in FIGS. 1–5 and 8–10, and is triangularly shaped. The drawer 12 includes an outer loop or run of wire 28 which runs along the bottom of the front 28a, along one side 28b, forms an outward side track projection 28c, extends along the back 28d, and runs along the other side to form another track projection 28e and side 28f joins with the front 28a. A pair of L-shaped side members, such as 29, are provided that are welded to and from triangular side or end portions with the outer member sides 28b and 28f.

Step-shaped members, such as 32, 34 and 36, are provided between the drawer sides or ends for use in forming the drawer bottom and back and are welded to the front and back sections 28a and 28d. A plurality of straight cross-run, such as 37a and 37b, extend transversely across the drawer and connect the L-shaped side members and stair-stepped members.

Figure 8:
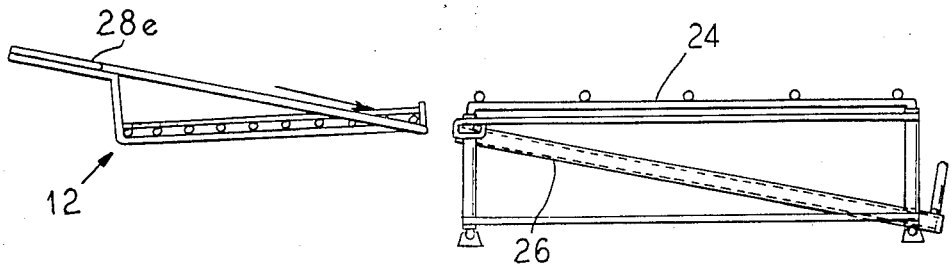
FIG. 8 shows the manner in which the drawer is inserted into the stand from the rear.

Assembly of the drawer to the stand is made as shown in FIG. 8. There the drawer is positioned at the rear of the stand with shoulders such as 28e in line with the track. The tray is moved forwardly and downwardly into the enclosure and into engagement with the track wherein the shoulder projections 28c and 28e fit into the track channels. The drawer can be moved downwardly into a use position forwardly of the enclosure at which the shoulders engage stops, such as 26c, at the end of each track so as to prevent the drawer from sliding further forwardly. The stops and the length of the projections 28c and 28e are adjusted so as to permit the tray to slide forwardly, be supported by the stand, and permit the drawer to drop approximately three inches past the edge of the support surface.

Figure 3:
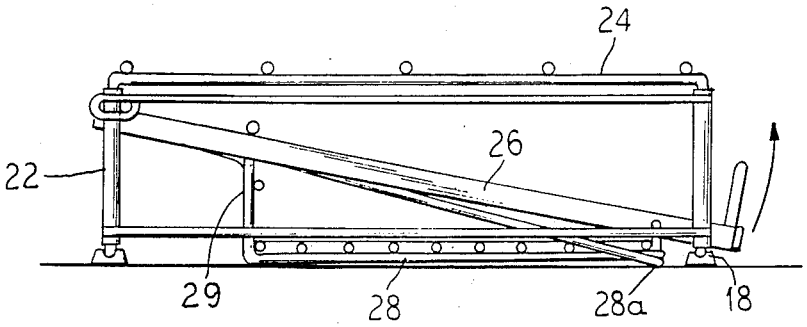
FIG. 3 is a side elevational view showing the system in a storage position.
Figure 4:
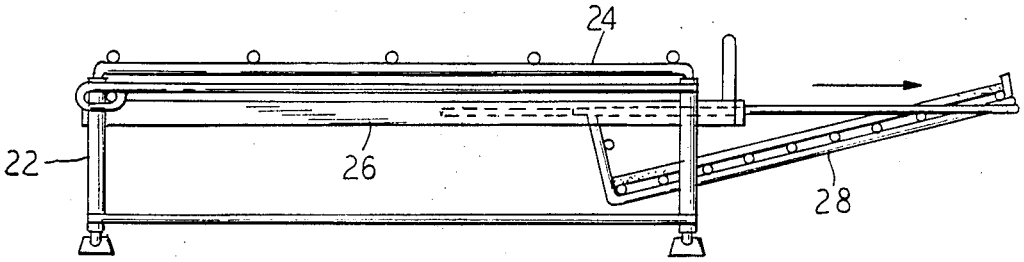
FIG. 4 is a side elevational view showing the retaining tray being withdrawn from the storage position.
Figure 5:
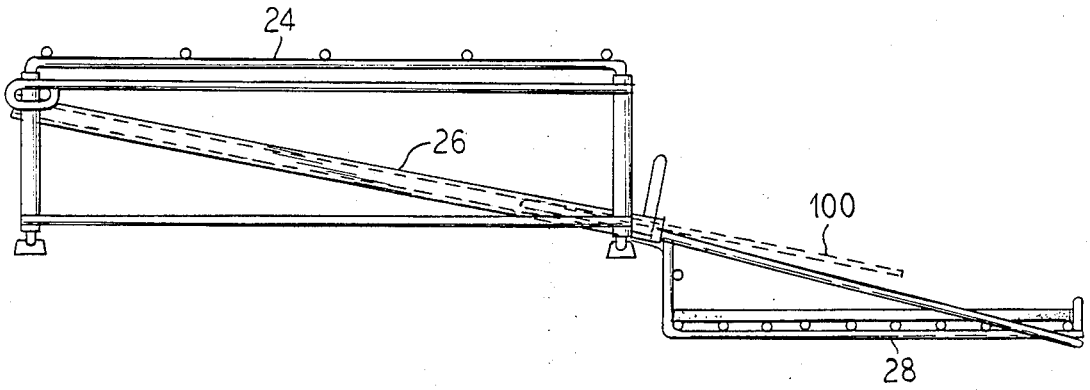
FIG. 5 shows a side elevational view with the retaining drawer in an operative position.
Figure 9:
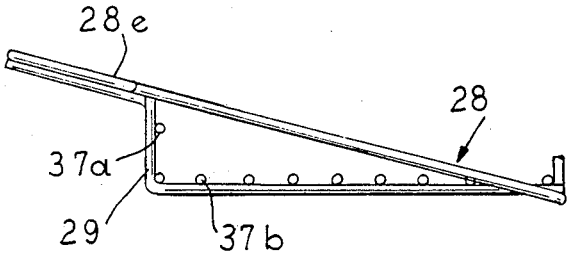
FIG. 9 is a side view of the drawer.

The track channel 26a into which the wire form tray fits has a width or first dimension between its sides. The diameter of the wire, which forms the tray, is of a second dimension which is less than the first width. The drawer and channel are of different dimensions so as to permit sliding, but this also permits the tray to skew relative to the channel. In operation, it is desirable that in the storge position the bottom of the drawer rests on the support surface inside the enclosure, as shown in FIG. 3, and when in use, the bottom of the tray must be horizontal and the tray be outward and downward of the enclosure. In storage the back of the tray rests on the heel of the L-shaped members, such as 29, and the front of the tray rests on the front end 28a of loop 28. It is seen from FIGS. 3 and 5 that the tray rods 28b, 28c, 28e, and 28f are not precisely in alignment with the channel but are slightly skewed relative thereto. In FIG. 5 an imaginary extension 100 of a tray rod and in alignment with the channel is shown.

In order to assure the desired positioning of the tray, a number of factors are taken into consideration and adjusted for. These include (1) the difference between the channel width and wire diameter; (2) the length of the shoulder sections such as 28c and 28e in the channel; (3) the angular skewing of the tray relative to the channel due to the dimensioned differences and shoulder lengths; (4) the height of the pivot points such as 22e; and (5) the angular attitude of the channel relative to the surface. When these factors are effectively taken into account, the desired support and positioning of the drawer tray is achieved.

In terms of the design, it is seen that the front opening for the stand and rear opening for the stand are greater than the height of the tray so as to permit the tray to move into and out of the stand. Next, the track pivots about the upper rear end of the stand and lays on a downward tilt against the front support, such as 18, of the stand. This downward slope substantially matches the downward slope of the tray whereby the tray rod, such as 28b as explained before, are in effect skewed relative to the tracks. Therefore, in the extended position, the tray is positioned downwardly over the side edge of the support surface. On the other hand, the tray in a stored position is held within the stand.

Moreover, it is seen that the tray can carry a computer support pad, such as 40, on which the keyboard can rest.

The parts are coated with an epoxy coating for reducing the coefficient of friction, finish and appearance. The coating process generally includes cleaning the parts to be coated by degreasing, derusting, phosphatizing and then rinsing.

Thereafter, the parts are dried in an oven and static created by electrifying the epoxy powder under a high voltage current and then spraying the electrified powder onto the preprocessed material. The powder adheres to the part because of the electrical attraction between the powder and part. Therefter, the coated powder is bonded into a smooth protective coating until the coating is hardened. This coating provides a protective coating and decorative coating for the wire formed unit in general. More specifically, the coating provides a sliding and friction-reducing surface between the tray and tracks.

In operation, as suggested in FIGS. 1–5, the central processing unit 4 is positioned on the top shelf of the stand and a monitor 6 is set on the CPU at about eye level. The keyboard is shown in the tray in FIG. 1. In order to pull the keyboard out, the track handle **26*b* is raised and the tray 12 is slid outwardly on the track. Thereafter the handle, track system and tray are lowered until the track system engages the legs such as 18**. When this occurs, the tray is at a lower position and at a comfortable position for keyboard operation.

The engagement of the tray shoulders **28*c* and 28*e* and the track front end stops, such as 26*c***, prevent the tray from falling outwardly from the track. Storage is by a reverse process. If removal of the tray is desired, it is accomplished by withdrawing the tray from the rear of the stand and track.

Although the invention has been described with respect to preferred embodiments, it is not to be so limited as changes and modifications can be made which are within the full intended scope of the invention as defined by the appended claims.

We claim as our invention:

1. A computer support and keyboard drawer comprising:

an enclosure for resting on a surface and supporting a computer body thereon and having a front, a back, a pair of sides and a top;

track means associated with the enclosure between the front and rear thereof;

drawer means operatively associated with said track means for carrying a computer keyboard and movable between a retracted storage position within the enclosure and an extended use position forward of the enclosure;

wherein the improvement comprises:

said enclosure, track means and drawer means being substantially formed of wires;

said track means being pivotally connected to the enclosure whereby said track means are positioned within the enclosure, slope forwardly and downwardly;

said track means including abutment means adjacent the forward end thereof for maintaining said drawer means associated with the track means in the use position;

said drawer means being extendable to a position forwardly and below the enclosure for use; and wherein:

said side members have interconnection means;

said top member is constructed to interfit with said interconnection means;

front and rear leg members, each constructed to extend between said side members and interfit with said interconnection means; and a pair of elastomeric feet mounted on each of said front and rear leg members

2. A computer support and keyboard drawer as in claim 1, wherein said track means includes:

a pair of spaced tracks, each pivotally secured to the stand adjacent an upper rear position of the stand at a side member and adapted to rest against the front leg member at a lower forward position in the storage and in the use position and extend from an upper rearward position to a lower forward position substantially along a diagonal of the side member.

3. A computer support and keyboard drawer as in claim 2, wherein said track abutment means comprise wire means associated with the front end of each track and positioned adjacent the front end of each track for maintaining said drawer within said track.

4. A computer support and keyboard drawer as in claim 3, wherein said each of said tracks has a C-shaped cross section and the abutment means comprises a wire rod member extending thereacross.

5. A computer support and keyboard drawer as in claim 2, wherein said drawer includes a pair of side members and rearwardly extending shoulder means that extend outwardly for engagement with said track members and said abutment means.

6. A computer support and keyboard drawer as in claim 5, wherein said drawer member defines a generally flat keyboard support surface.

7. A computer support and keyboard drawer as in claim 6, wherein the keyboard support surface is constructed to engage a support surface in the storage position and said keyboard surface is generally horizontal in the use position.

8. A computer stand and keyboard drawer wherein said stand comprises an enclosure, track system and drawer:

wherein said enclosure comprises:

front and rear wire form leg members, each having an elongated transverse section and upturned end section and a pair of rubber feet mounted to each transverse section;

a pair of spaced side members, each having a pair of spaced tubular supports, an elongated bottom wire member connected to each of said support members and an elongated upper wire member having a loop at its back end secured to each of said support members, each of said support members constructed to interfit with one of said upstanding of said legs;

a top shelf-like surface formed of wire members having a pair of side members, each having an elongated section extending from front to rear of said stand and a downturned section at each end for interfitting with a support member of said side members; and a plurality of transverse members extending between said top side members and each having an end secured thereto;

wherein said track system comprises:

a pair of spaced C-shaped channel members facing each other;

an elongated wire member forming a rear member secured to said channel members and defining shoulder extending outwardly thereof for pivotal connection to said stand side members, at least one intermediate elongated cross member having ends secured to said channels, a front cross member having ends secured to said channel and arranged to cooperate with said channel at the front end thereof, the rear end thereof being open, and stopper means associated with and extending across the front of each of said channel members; and wherein the drawer comprises:

a wire member bent to form a first triangular side member, a first outwardly slide shoulder positioned outwardly of the first side member, a rear cross member, a second outwardly positioned sliding shoulder member and an inwardly positioned triangularly shaped side member; said sliding shoulder means constructed to slide within said track members and engage said abutment means; a plurality of transverse cross members.

* * * * *